US005967510A

United States Patent [19]

Ono et al.

[11] Patent Number: 5,967,510

[45] Date of Patent: Oct. 19, 1999

[54] SHEET TRANSFER SYSTEM

[75] Inventors: Takahiro Ono; Takeshi Kakinuma, both of Kyoto; Nobuyoshi Suzuki, Aichi-ken; Yasuhiro Fujimoto; Masahiro Ueda, both of Tokyo, all of Japan

[73] Assignee: Riso Kagaku Corporation, Tokyo, Japan

[21] Appl. No.: 09/061,345

[22] Filed: Apr. 17, 1998

[30] Foreign Application Priority Data

Apr. 18, 1997 [JP] Japan ..... 9-115019

[51] Int. Cl.[6] ..... B65H 29/32

[52] U.S. Cl. ..... 271/196; 271/197; 271/276

[58] Field of Search ..... 271/195, 196, 271/197, 276

[56] References Cited

U.S. PATENT DOCUMENTS

| | | | |
|---|---|---|---|
| 4,299,381 | 11/1981 | Smith . | |
| 4,447,817 | 5/1984 | Naramore . | |
| 5,139,253 | 8/1992 | Bohme et al. | 271/197 |
| 5,422,463 | 6/1995 | Gooray et al. . | |
| 5,712,672 | 1/1998 | Gooray et al. . | |

FOREIGN PATENT DOCUMENTS

| | | |
|---|---|---|
| 40 35 357 | 5/1991 | Germany . |
| 60-019637 | 1/1985 | Japan . |
| 03 166159 | 7/1991 | Japan . |
| 8-281923 | 10/1996 | Japan . |
| 2 282 364 | 4/1995 | United Kingdom . |

*Primary Examiner*—David H. Bollinger
*Attorney, Agent, or Firm*—Sixeby, Friedman, Leedom & Ferguson, P.C.; Donald R. Studebaker

[57] ABSTRACT

A sheet transfer system for transferring sheets on which an image is recorded by an image forming system and discharging the sheets to a tray includes a conveyor belt and a vacuum fan which generates a suction force for attracting the sheets against the conveyor belt. The suction force is stronger at the downstream side portion of the conveyor belt.

5 Claims, 9 Drawing Sheets

SHEET TRANSFER SYSTEM

BACKGROUND OF THE INVENTION

1. Field of the Invention

This invention relates to a sheet transfer system, and more particularly to a sheet transfer system for transferring sheets, on which an image is recorded by an image forming system such as a printer or a copier, to a tray.

2. Description of the Related Art

FIG. 9 shows a typical printer. A paper supply table 2 is disposed on one side of a printer body 1 and printing papers 3 are stacked on the paper supply table 2. The printing papers 3 are taken in the printer body 1 by an intake roller 4 and only the uppermost printing paper in the stack is separated from the stack and fed into the printer body 1 by a pair of separator rollers 5. The printing paper 3 thus supplied to the printer body 1 is passed through a resist roller 6 and an ink transfer drum 7, whereby an image is recorded on the printing paper 3 by stencil printing. The printing paper 3 bearing thereon a printed image is transferred by a sheet transfer system 8 and discharged to a tray 9 on the other side of the printer body 1.

In the case of a printer, since the printed paper is still wet with ink, the printed paper is generally transferred by use of a vacuum conveyor (a suction belt) not to contact the front side of the printed paper bearing thereon the printed image. As is well known in the art, the vacuum conveyor generally comprises a pair of conveyor belts 8*a* which extend in parallel to the direction of transfer on opposite sides of the path along which the printed papers are transferred, and a vacuum fan 8*b* disposed between the conveyor belts 8*a* below them. When the vacuum fan 8*b* is operated to generate suction force, the printed paper is attracted against the conveyor belts 8*a* under the suction force and when the conveyor belts 8*a* are driven, the printed paper is conveyed and discharged onto the tray 9.

Conventionally the vacuum fan 8*b* is disposed at the middle of the conveyor belts 8*a* as seen in the longitudinal direction thereof. This is for generating the suction force as uniform as possible over the entire area of the transfer area.

However, in fact, the suction force is most strong at the middle of the conveyor belts 8*a* where the vacuum fan 8*b* is disposed and is gradually reduced toward the ends of the conveyor belts 8*a*. Further when the area of the part of the printed paper on which the suction force from the vacuum fan 8*b* acts is reduced, the attracting force (i.e., the paper holding force) is naturally weakened. When the attracting force is weak, the rotating force of the conveyor belts 8*a* cannot be efficiently transmitted to the printed paper and the transfer force is weakened.

As a result, when the trailing end of the printed paper passes the middle portion of the transfer path, where the vacuum fan 8*b* is disposed, the printed paper comes to exist only where the attractive force is weak and the transfer force is abruptly weakened. Further when the leading end portion of the printed paper is transferred beyond the downstream end of the conveyor belts 8*a,* the area of the part of the printed paper on which the suction force from the vacuum fan 8*b* acts is reduced, which also results in a weak transfer force. When the transfer force is weakened, the printed paper stalls and sometimes cannot be properly discharged. Further there arises a problem that the printed paper cannot be ejected by a desired distance and cannot be positioned in place on the tray so that the printed papers are stacked with their edges aligned with each other.

SUMMARY OF THE INVENTION

In view of the foregoing observations and description, the primary object of the present invention is to provide a sheet transfer system which can constantly provide a desired transfer force to the printed paper and surely discharge the printed paper.

In accordance with the present invention, there is provided a sheet transfer system for transferring sheets on which an image is recorded by an image forming system and discharging the sheets to a tray, the sheet transfer system comprising a conveyor belt and an attracting force generating means which generates an attracting force for attracting the sheets against the conveyor belt, wherein the improvement comprises that the attracting force is stronger at the downstream side portion of the conveyor belt.

The expression "the attracting force is stronger at the downstream side portion of the conveyor belt" means that the attracting force is relatively strong at the downstream side portion as compared with that at the upstream side portion or the central portion.

For example, the attracting force can be made stronger at the downstream side portion of the conveyor belt by disposing the attracting force generating means on the downstream side of the middle of the conveyor belt as seen in the direction of transfer.

In one embodiment of the present invention, a plurality of first vacuum holes are formed in the conveyor belt. A guide plate is provided below the part of the conveyor belt which contributes to transfer of the sheet and a plurality of second vacuum holes are formed in the guide plate at a part where the second vacuum holes can be aligned with the first vacuum holes as the conveyor belt runs so that the attracting force generated by the attracting force generating means acts on the sheet through the first and second vacuum holes and the effective area which actually contributes to supplying the attracting force to the sheet to be transferred is determined by the area over which the first and second vacuum holes overlap with each other. The attracting force can be made stronger at the downstream side portion of the conveyor belt by increasing the area over which the first and second vacuum holes overlap with each other at the downstream side portion of the conveyor belt.

An air blow means may be provided above the downstream side of the conveyor belt to urge the sheet toward the conveyor belt by the pressure of air blown from the air blow means.

A plurality of cutaway portions may be formed on a downstream side pulley around which the conveyor belt is passed so that the attracting force can be applied through the cutaway portions.

In the transfer system of the present invention, even when the leading end portion of the sheet is transferred beyond the downstream end of the conveyor belt and the area of the part of the printed paper on which the suction force from the vacuum fan acts is reduced, the sheet can be still firmly held on the conveyor belt under a desired attracting force, whereby a desired transfer force can be applied to the sheet until it is finally discharged onto the tray. Thus the aforesaid problems that the sheet stalls and sometimes cannot be properly discharged, or the sheet cannot be ejected by a desired distance and cannot be positioned in place on the tray so that the sheets are stacked with their edges aligned with each other can be overcome.

Further since the attracting force is weaker at the upstream side end portion than the downstream side end portion, the following problem can be overcome. That is, when a sheet is delivered from an upstream side sheet transfer system to a downstream side sheet transfer system, the sheet once comes to extend over both the transfer systems. In such a case, when the transfer speed of the downstream side sheet transfer system is lower than that of the upstream side transfer system, the central portion of the sheet can be bulged upward due to the difference in the transfer speed since both the leading end portion and the trailing end portion of the sheet are held by the respective transfer systems. However when the attracting force is weaker at the upstream side end portion than at the downstream side end portion, the sheet holding force of the upstream side transfer system prevails over that of the downstream side transfer system and the sheet can be smoothly delivered to the downstream side transfer system without the sheet being deformed.

DESCRIPTION OF THE PREFERRED EMBODIMENTS

Figure 1:
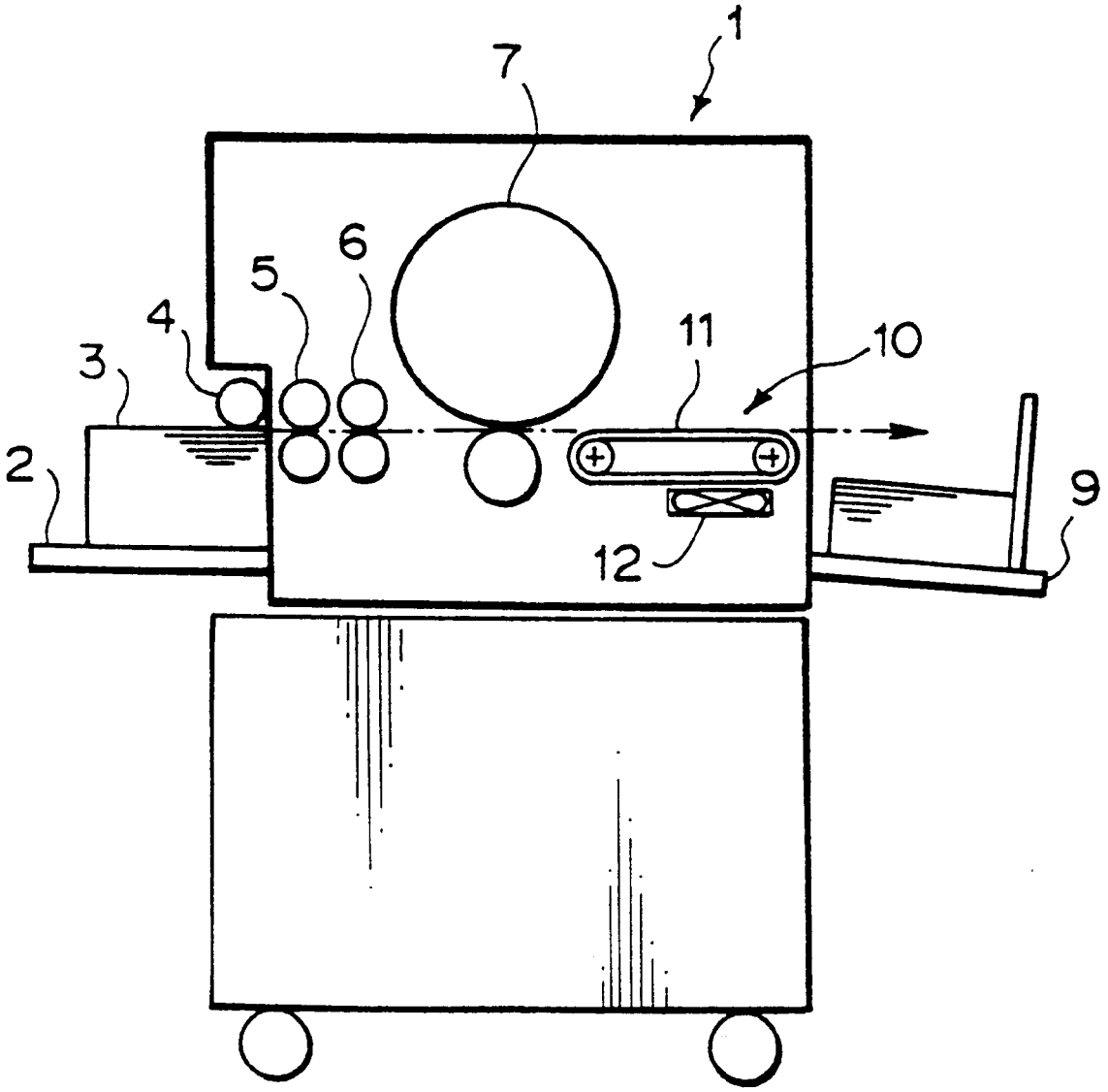
FIG. 1 is a front view of a printer in which a sheet transfer system in accordance with a first embodiment of the present invention is employed.
Figure 9:
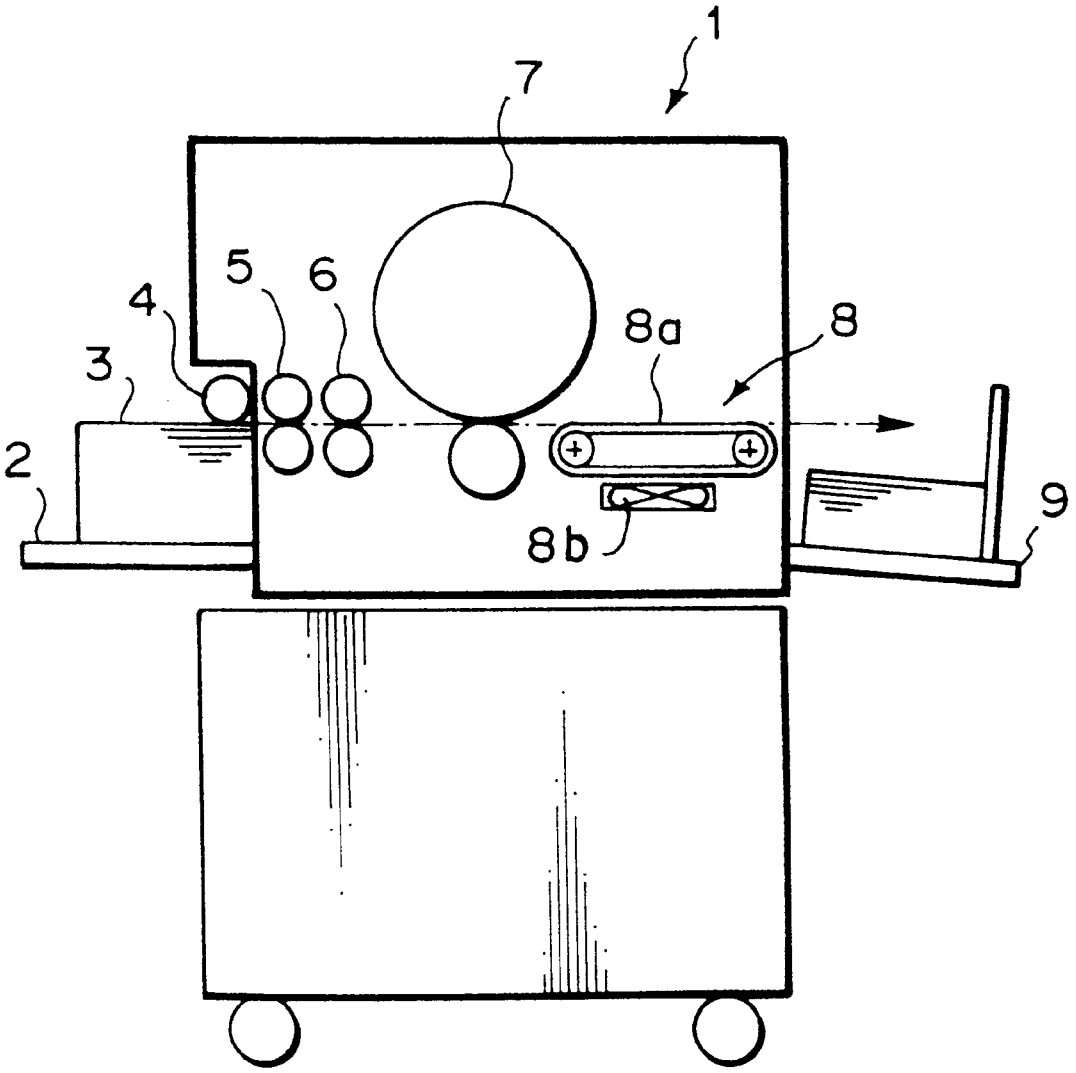
FIG. 9 PRIOR ART
FIG. 9 is a front view of a printer provided with a conventional sheet transfer system.

In FIG. 1, a sheet transfer system 10 in accordance with a first embodiment of the present invention is disposed inside a printer body 1 of a stencil printer. The printer shown in FIG. 1 is substantially the same as that shown in FIG. 9 except the sheet transfer system, and accordingly the elements analogous to those shown in FIG. 9 are given the reference numerals.

The sheet transfer system 10 is a vacuum conveyor and basically comprises a pair of conveyor belts 11 which extend in parallel to the direction of transfer of the printed paper on opposite sides of the path along which the printed papers are transferred, and a vacuum fan 12 disposed between the conveyor belts 11 below them. In the sheet transfer system 10, the printed paper is attracted against the conveyor belts 11 under suction generated by the vacuum fan 12.

Figure 2:
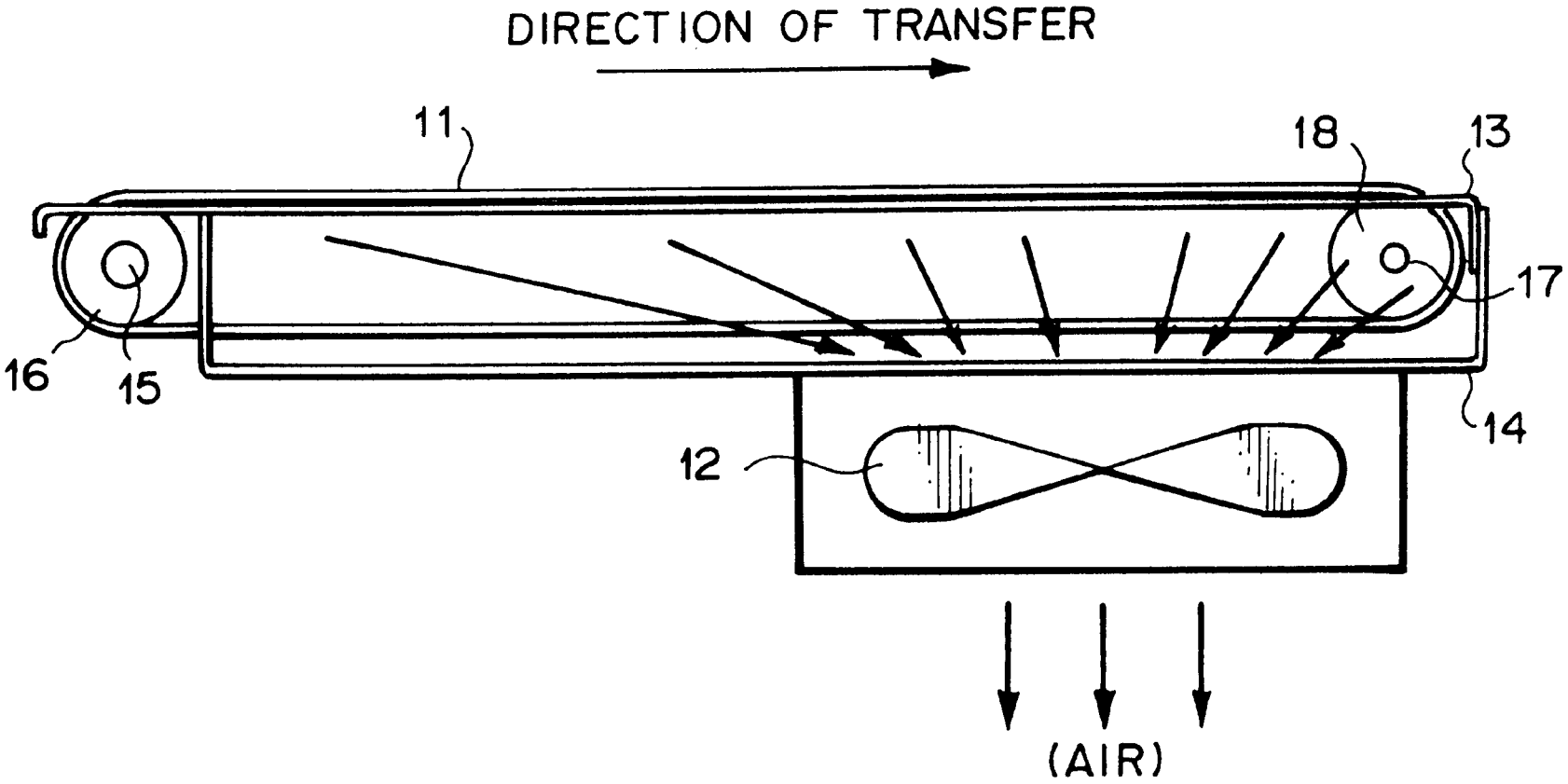
FIG. 2 is a front view of the sheet transfer system.

In this embodiment, the vacuum fan 12 is disposed on the downstream side of the middle of the conveyor belts 11 as seen in the direction of transfer. More specifically, as clearly shown in FIGS. 2 and 3, the vacuum fan 12 is disposed in the downstream side end portion of the sheet transfer system 10. With this arrangement, the suction force is the strongest in the downstream side end portion of the sheet transfer passage above the vacuum fan 12 and the weakest in the upstream side end portion. That is, the suction force is gradually increased from the upstream end toward the downstream end.

A flat guide plate 13 extends horizontally below the upper run of the conveyor belts 11 substantially over entire area of the sheet transfer system 10. A casing 14 which opens upward is mounted on the lower surface of the guide plate 13 in a predetermined position. The vacuum fan 12 is mounted on the bottom of the casing 14 at the downstream side end portion of the casing 14. The inner space of the casing 14 is communicated with the vacuum fan 12 through an opening formed in the bottom of the casing 14. When the vacuum fan 12 is operated, air in the casing 14 is evacuated and suction force is generated.

A drive shaft 15 extends horizontally in perpendicular to the direction of transfer on the upstream side of the sheet transfer system 10 and a pair of drive pulleys 16 are mounted on the drive shaft 15 at a predetermined distance from each other. The drive shaft 15 is rotated at a predetermined speed by a drive motor (not shown). A driven shaft 17 extends horizontally in parallel to the drive shaft 15 inside the casing 14 on the downstream side of the casing 14. Opposite end portions of the driven shaft 17 are supported for rotation on the side walls of the casing 14. A pair of driven pulleys 18 are mounted on the driven shaft 17 at a distance from each other. Thus the driven pulleys 18 are disposed inside the casing 14. The distance between the driven pulleys 18 is equal to that between the drive pulleys 16.

A cutaway portion 13*a* is formed in the guide plate 13 at a part opposed to each driven pulley 18 and the driven pulley 18 projects outside through the cutaway portion 13*a*. Each conveyor belt 11 is passed around one of the drive pulleys 16 and one of the driven pulleys 18 which are opposed to each other in the direction of transfer. The shape of the cutaway portion 13*a* is similar to that shown in FIG. 5. When the drive shaft 15 is rotated, the conveyor belts 11 are run and the driven pulleys 17 are rotated by way of the drive pulleys 16. The parts of the conveyor belts 11 which are positioned above the guide plate 13 are able to contact the printed paper and contribute to transfer of the printed paper. The upper surface of the guide plate 13 is in contact with the conveyor belts 11 and the part of the upper surface of the guide plate 13 between the conveyor belts 11 supports the printed paper together with the conveyor belts 11.

Each conveyor belt 11 is provided with a plurality of first vacuum holes 11*a* which are circular holes of the same diameter and are arranged in two rows at regular intervals. The first vacuum holes 11*a* in one row is shifted from those in the other row in the longitudinal direction of the conveyor belt 11 so that each first vacuum hole 11*a* in one row is positioned at the middle of adjacent two first vacuum holes 11*a* in the other row as seen in the transverse direction of the conveyor belt 11. A plurality of second vacuum holes 13*b* are formed in the guide plate 13 at the portion opposed to each conveyor belt 11. The second vacuum holes 13*b* are arranged in two rows in the same manner as the first vacuum holes 11*a*. Each of the second vacuum holes 13*b* is in the form of a slit extending along the axis of the row of the first vacuum holes 11*a*. The effective area which actually contributes to supplying suction force to the printed paper to be transferred is the overlapping portion of the first and second vacuum holes 11*a* and 13*b*. When air in the casing 14 is evacuated by the vacuum fan 12, air above the guide plate 13 is sucked into the casing 14 through the overlapping portion of the first and second vacuum holes 11*a* and 13*b* and the printed paper on the conveyor belts 11 are pressed against the conveyor belts 11*a*. Then when the conveyor belts 11 are run, the printed paper on the belts 11 are conveyed.

The widths of the second vacuum holes 13*b* differ in the longitudinal direction of the conveyor belts 11. That is, the widths w of the second vacuum holes 13*b* on the upstream side are smaller than the widths w' of the second vacuum holes 13*b* on the downstream side. As a result, the suction force acting on the printed paper is larger on the downstream side than on the upstream side.

Thus in this embodiment, the attracting force acting on the printed paper is increased from the upstream side toward the downstream side by shifting the vacuum fan 12 toward the downstream side and making the widths of the second vacuum holes 13*a* larger on the downstream side than on the upstream side, whereby the printed paper can be surely held until it is discharged to the tray and can be discharged in an optical manner.

Further in this particular embodiment, a plurality of cutaway portions 18*a* are formed in each of the driven pulleys 18. Each cutaway portion 18*a* is in the form of a channel formed around the driven pulley 18. That is, the driven pulley 18 is reduced in diameter at the cutaway portion 18*a*. With this arrangement, attracting force can be applied to the printed paper through the cutaway portion 18*a* and the first vacuum hole 11*a*, and accordingly attracting force can be applied up to the driven pulleys 18, where conventionally no attracting force is applied to the printed paper. That is, attracting force can be applied up to the extreme discharge end of the transfer path, whereby the printed paper can be more surely conveyed and discharged.

Figure 3:
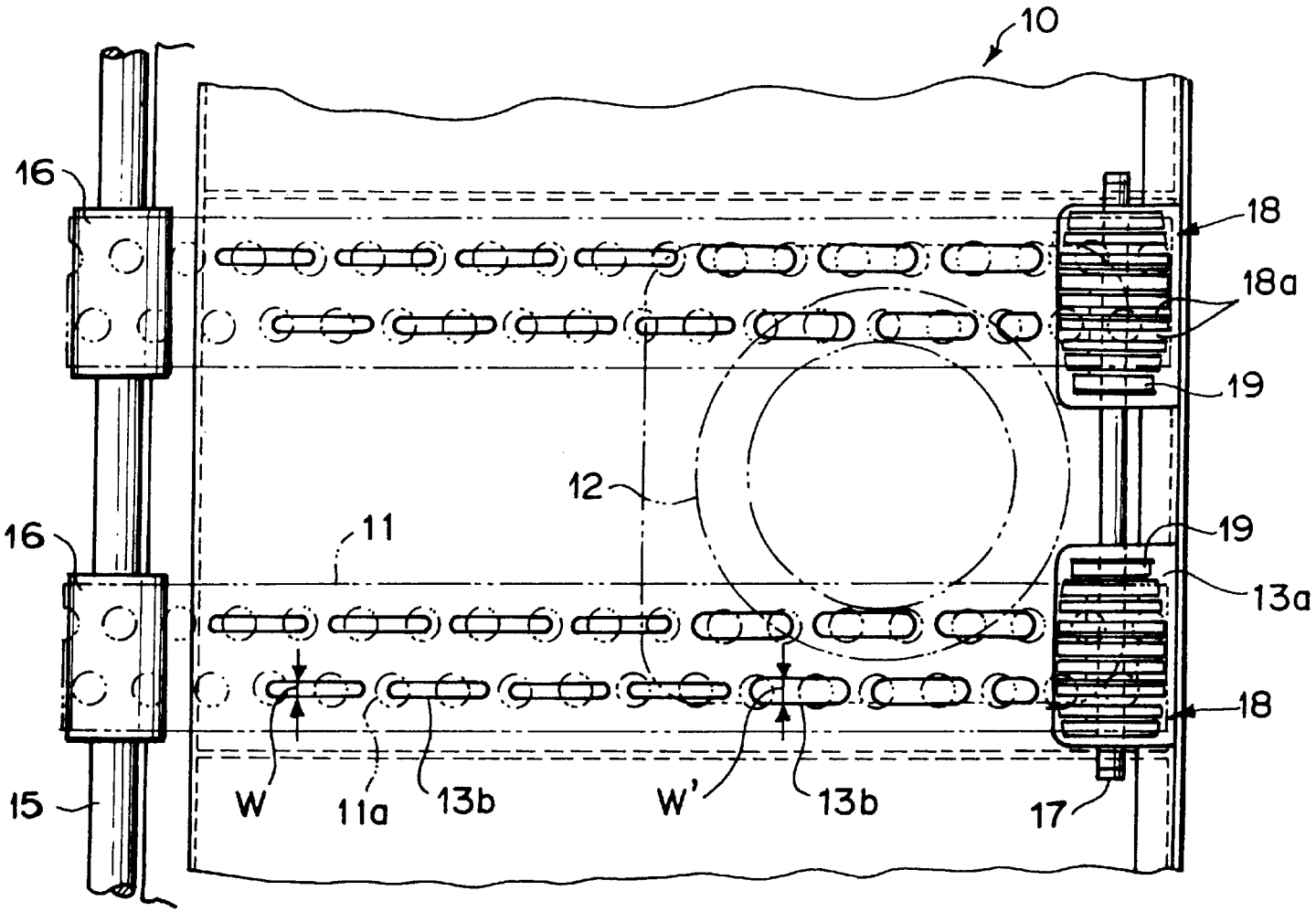
FIG. 3 is a plan view of the sheet transfer system.
Figure 4:
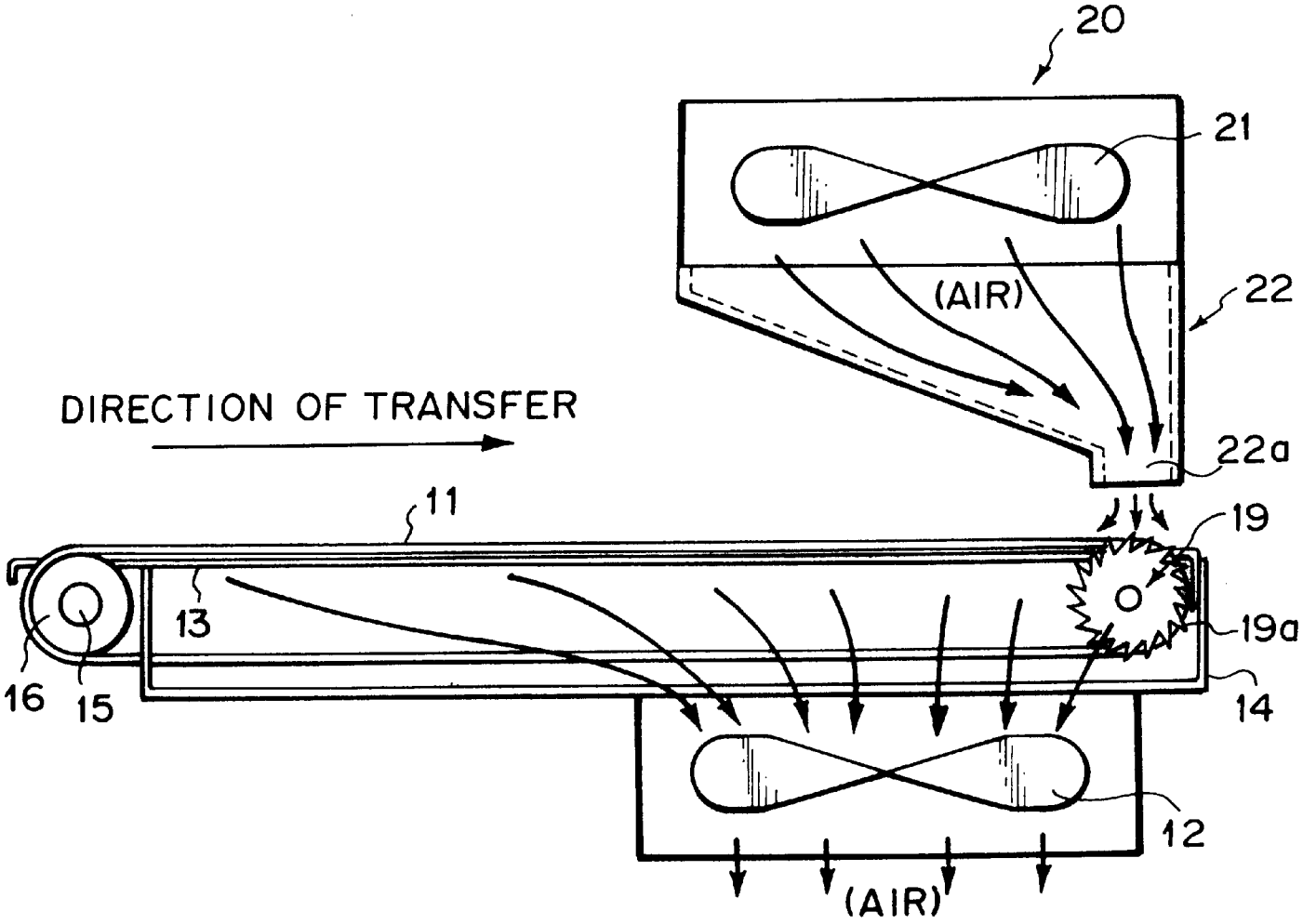
FIG. 4 is a front view of a sheet transfer system in accordance with a second embodiment of the present invention.

Reference numeral 19 in FIG. 3 denotes a kick roller which has a serrated peripheral edge as shown in FIG. 4 and ejects the printed paper toward the tray by pushing the trailing edge of the paper by the serrated peripheral edge thereof. Each kick roller 19 is mounted on the driven shaft 17 on the inner side of the driven pulley 18 and a part of the outer peripheral edge of the kick roller 19 projects upward above the conveyor belts 11.

Though in this embodiment, the effective area which actually contributes to supplying suction force to the printed paper is made to be larger on the downstream side by increasing the widths of the second vacuum holes 13*b*, the effective area may be changed in other various manners. For example, it may be changed by changing the number of the second vacuum holes 13*a* which overlap with the first vacuum holes 11*a* at one time with the width of the second vacuum holes 13*a* kept uniform (e.g., by arranging so that one second vacuum hole 13*b* overlaps with one first vacuum hole 11*a* on the upstream side and a pair of second vacuum holes 13*a* overlap with one first vacuum hole 11*a*), or by changing the density of the second vacuum holes 13*b*.

Figure 5:
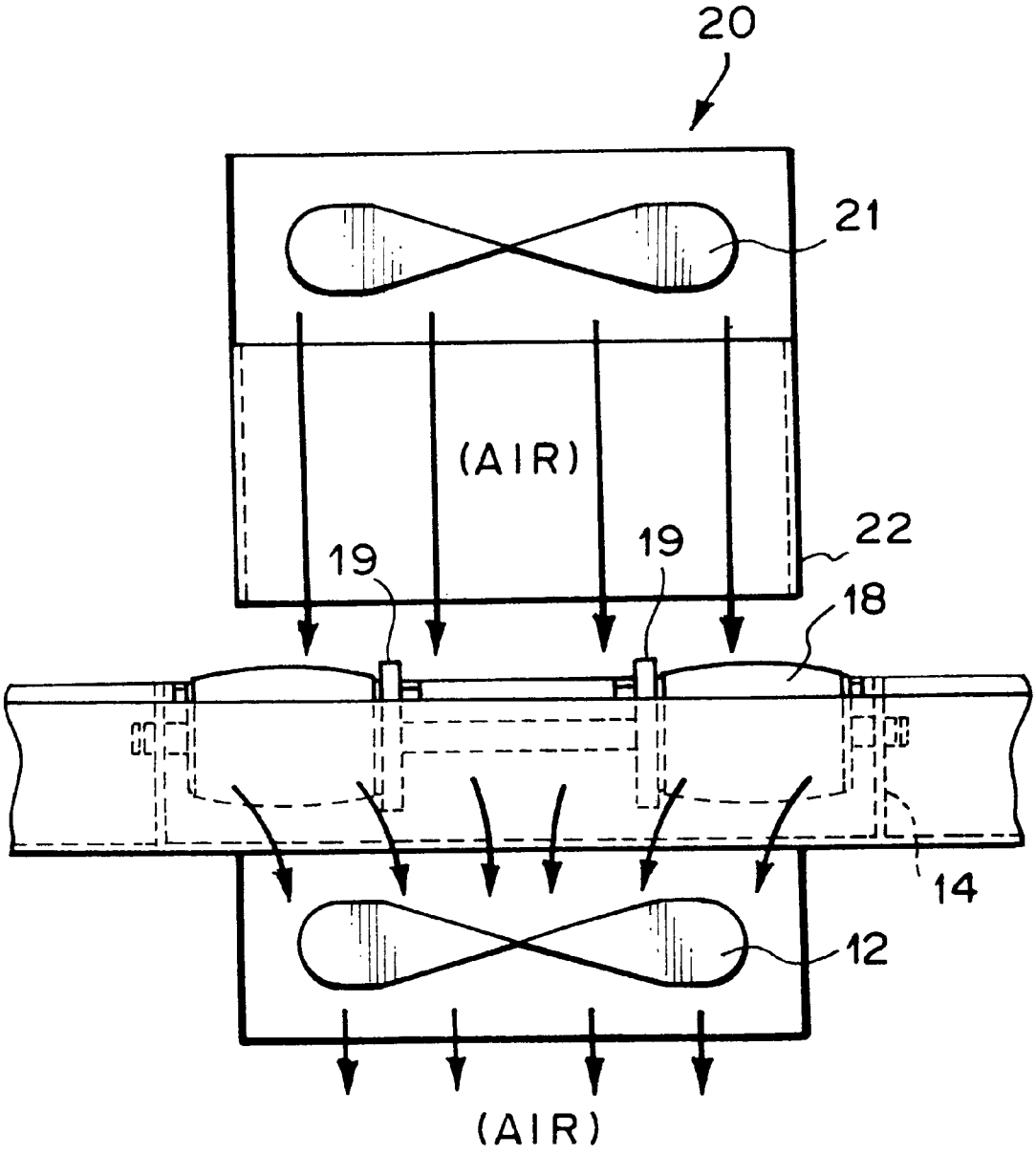
FIG. 5 is a side view of the sheet transfer system.

A second embodiment of the present invention will be described with reference to FIGS. 4 to 6, hereinbelow. In this embodiment, an air blower 20 is provided above the downstream side end portion of the transfer path. The air blower 20 comprises a fan 21 and an air guide pipe 22 whose air outlet port 22*a* is positioned just above the driven pulleys 18. When the fan 21 is operated, air above the fan 21 is taken in and blow over the driven pulleys 18 and the kick rollers 19 through the air outlet port 22*a*.

Thus the printed paper on the conveyor belts 11 is pressed against the belts 11 by air blown from above through the air outlet port 22*a*. The air pressure together with the attracting force by the vacuum fan 12 causes the printed paper to surely receive the transfer force until its trailing edge is conveyed to the downstream end. Further, in this particular embodiment, since the air outlet port 22*a* is disposed just above the driven pulleys 18 and the kick roller 19, the trailing end portion of the printed paper is bent downward under the air pressure when the trailing end portion comes to the kick rollers 19 and accordingly the teeth 19*a* of the kick rollers 19 can be surely brought into engagement with the trailing edge of the printed paper, whereby the transfer force by the kick roller 19 can be surely transmitted to the printed paper and the printed paper can be discharged with a desirable transfer force.

Figure 6:
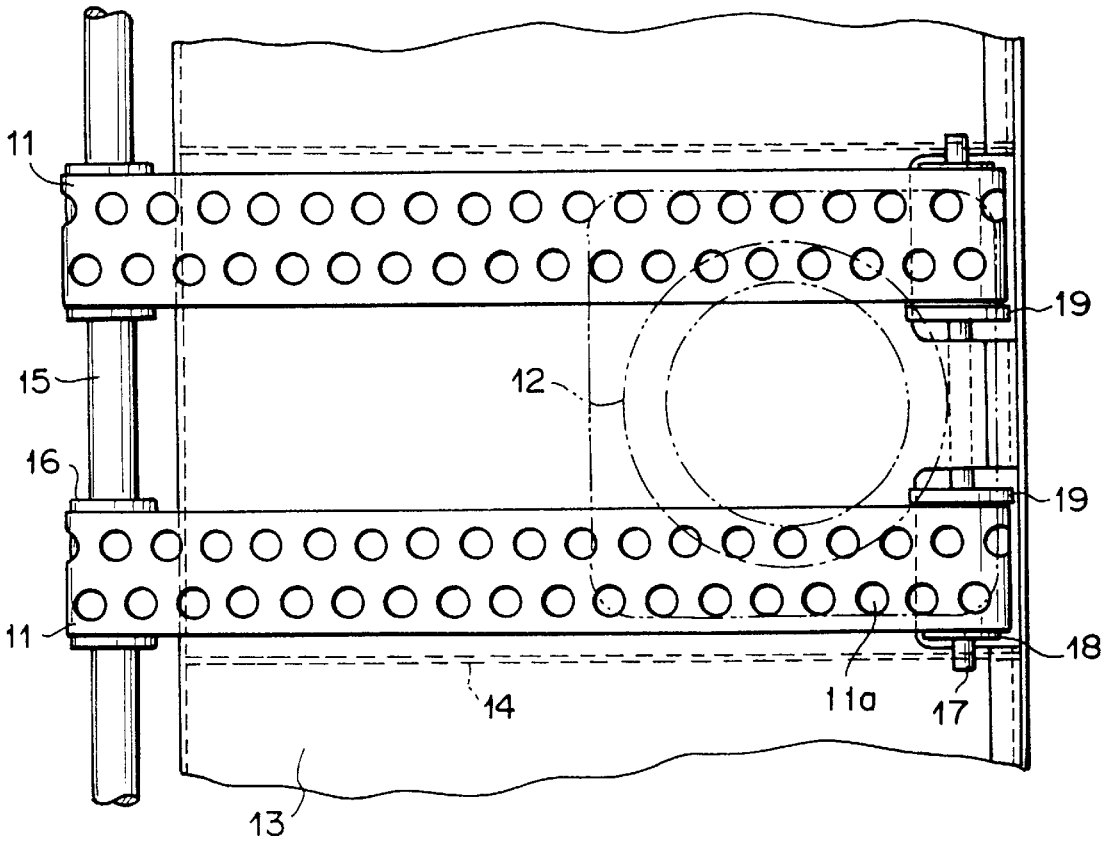
FIG. 6 is a plan view of the sheet transfer system.

Though the second vacuum holes in the guide plate 13 are not shown in FIG. 6, the effective area which actually contributes to supplying suction force to the printed paper may be made to be larger on the downstream side in the manner described above in conjunction with the first embodiment, which is preferable, though not necessary, since the effect of the air blower and the effect of the biased attracting force distribution associate with each other. Further the driven pulleys 18 may be provided with the cutaway portions described above, though not necessary.

A third embodiment of the present invention will be described with reference to FIGS. 7A and 7B. The sheet transfer system of this embodiment basically the same as that of the second embodiment except that the arrangement of the air blower is simplified. That is, though in the second embodiment, both the vacuum fan 12 and the air blower fan 21 are used, the vacuum fan 12 doubles as the air blower fan 21 in this embodiment, whereby the number of the parts is reduced, the structure is simplified and the overall size of the system is reduced.

Figure 7B:
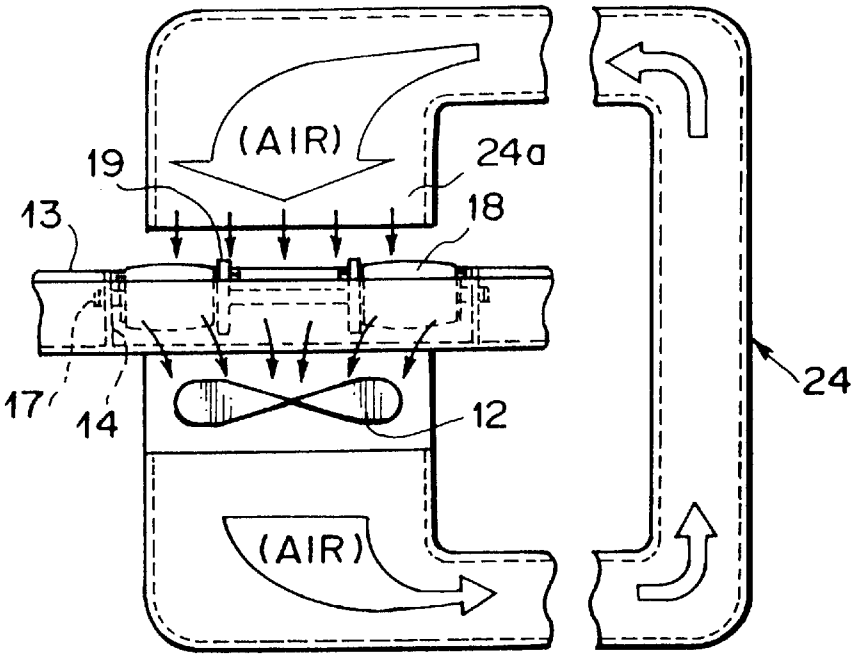
FIG. 7B is a rear view of the sheet transfer system.
Figure 7A:
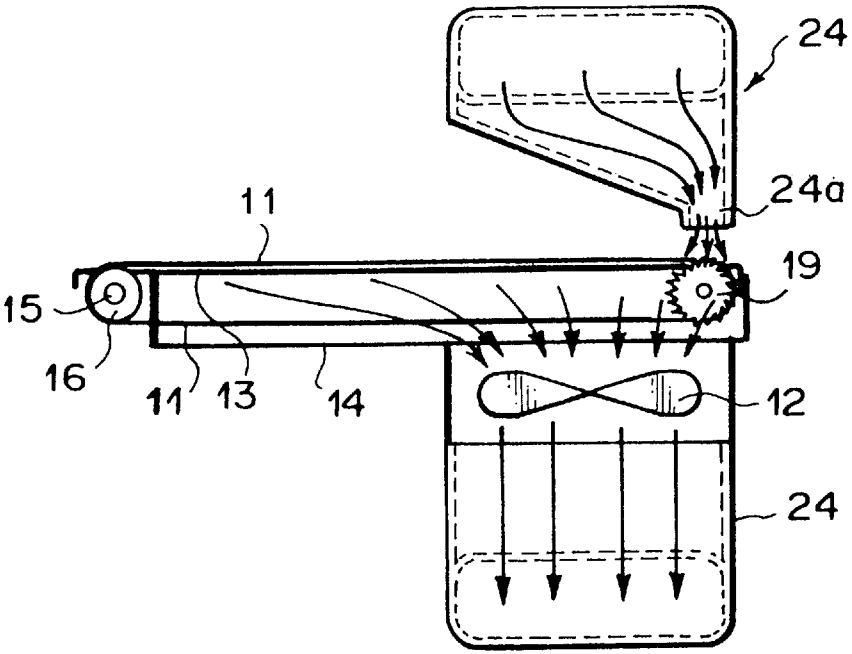
FIG. 7A is a plan view of a sheet transfer system in accordance with a third embodiment of the present invention.

As shown in FIGS. 7A and 7B, there is provided a circulation passage 24 extending from below the vacuum fan 12 to above the conveyor belts 11. The circulation passage 24 is disposed, for instance, beside the conveyor belts 11 not to interfere with transfer of the printed paper to the tray 9. The upper open end of the circulation passage 24 forms an air outlet port 24*a*. The air outlet port 24*a* is positioned just above the downstream side end, more particularly just above the driven pulleys 18 and the kick rollers 19. When the vacuum fan 12 is operated, the printed paper is attracted against the conveyor belts 11 under the suction force generated by the vacuum fan 12 and at the same time air in the casing 14 is led upward through the circulation passage 24 to be blown downward through the air outlet port 24*a*. The printed paper on the conveyor belts 11 is pressed against the belts 11 by the air pressure as in the second embodiment.

Figure 8:
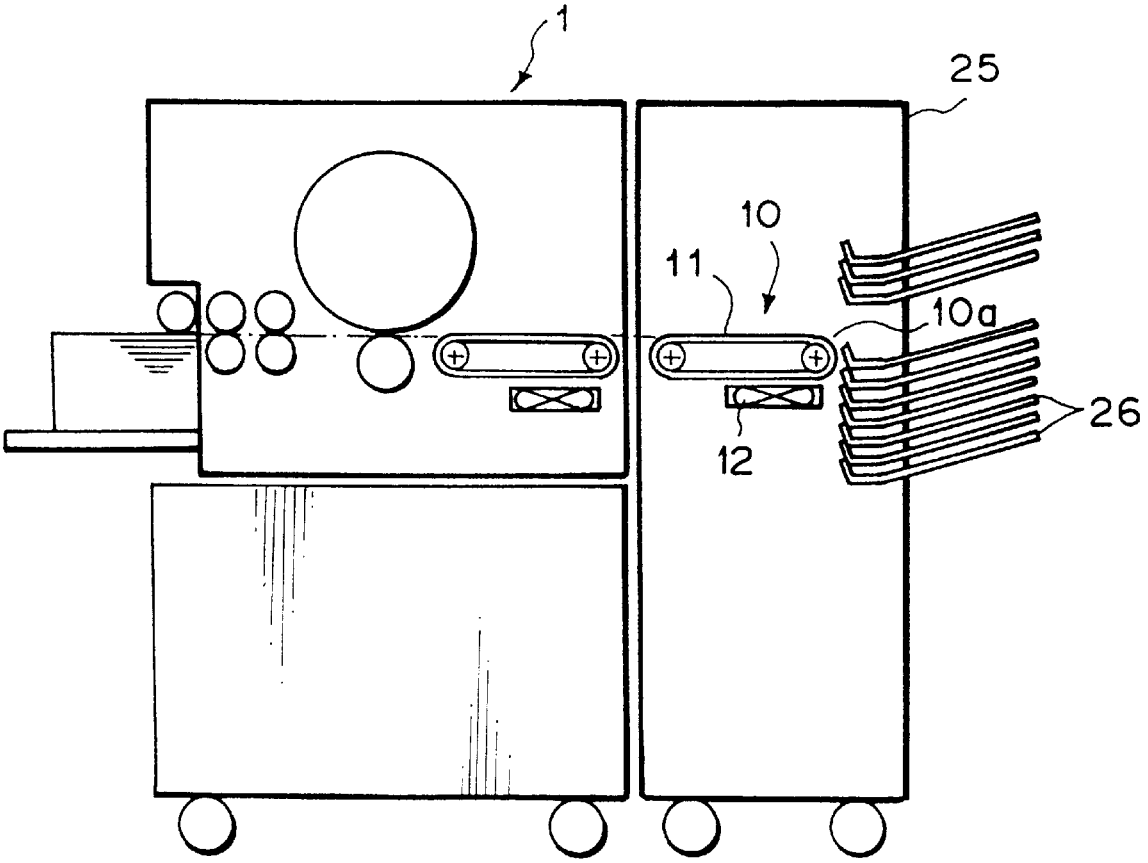
FIG. 8 is a front view showing a printer attached with a sorter in which a sheet transfer system in accordance with the present invention is employed.

Though, in the embodiments described above, the sheet transfer system of the present invention is built in the printer body, the sheet transfer system of the present invention may be employed in other systems. For example, as shown in FIG. 8, the sheet transfer system of the present invention may be incorporated in a sorter 25 which is disposed beside the printer 1 to sort the printed papers discharged from the printer 1.

The sorter 25 is provided with a plurality of trays or bins 26. The trays 26 are moved up and down by an up-and-down mechanism (not shown) and one of the trays 26 is selectively positioned near the sheet outlet port 10*a* of the sheet transfer system 10. The sheet transfer system 10 receives a printed sheet from the printer 1 and transfers the paper onto the tray placed near the sheet outlet port 10*a*. The sorter 25 may be of a known structure.

What is claimed is:

1. A sheet transfer system for transferring sheets on which an image is recorded by an image forming system and discharging the sheets to a tray, said sheet transfer system comprising:

a conveyor belt; and an attracting force generating means which generates an attracting force for attracting the sheets against the conveyor belt, said attracting force generating means includes a suction source disposed on the downstream side of the middle of the conveyor belt as seen in the direction of transfer whereby the attracting force is stronger at the downstream side portion of the conveyor belt.

2. A sheet transfer system for transferring sheets on which an image is recorded by an image forming system and discharging the sheets to a tray, said sheet transfer system comprising:

a conveyor belt; and an attracting force generating means which generates an attracting force for attracting the sheets against the conveyor belt, a plurality of first vacuum holes are formed in the conveyor belt, a guide plate is provided below the part of the conveyor belt which contributes to transfer of the sheet and a plurality of second vacuum holes are formed in the guide plate at a part where the second vacuum holes can be aligned with the first vacuum holes as the conveyor belt runs so that the attracting force generated by the attracting force generating means acts on the sheet through the first and second vacuum holes and the effective area which actually contributes to applying the attracting force to the sheet to be transferred is determined by the area over which the first and second vacuum holes overlap with each other, wherein the attracting force is made stronger at the downstream side portion of the conveyor belt by increasing the area over which the first and second vacuum holes overlap with each other at the downstream side portion of the conveyor belt.

3. A sheet transfer system for transferring sheets on which an image is recorded by an image forming system and discharging the sheets to a tray, said sheet transfer system comprising:

a conveyor belt; and an attracting force generating means which generates an attracting force for attracting the sheets against the conveyor belt, said attracting force generating means including an air blow means provided above the downstream side of the conveyor belt to urge the sheet toward the conveyor belt by the pressure of air blown from the air blow means, whereby the attracting force is stronger at the downstream side portion of the conveyor belt.

4. A sheet transfer system for transferring sheets on which an image is recorded by an image forming system and discharging the sheets to a tray, the sheet transfer system comprising:

a conveyor belt;

an attracting force generating means for generating an attracting force for attracting the sheets against the conveyor belt; and a kick roller coupled to said conveyor belt and having a serrated peripheral edge.

5. A sheet transfer system for transferring sheets on which an image is recorded by an image forming system and discharging the sheets to a tray, the sheet transfer system comprising:

a conveyor belt supported by at least one pulley, a reduced diameter channel being formed around a periphery of said at least one pulley; and an attracting force generating means comprising a suction source for generating an attracting force for attracting the sheets against the conveyor belt, said suction source communicating with said reduced diameter channel.

* * * * *